US010262677B2

(12) United States Patent
Bocko et al.

(10) Patent No.: US 10,262,677 B2
(45) Date of Patent: Apr. 16, 2019

(54) SYSTEMS AND METHODS FOR REMOVING REVERBERATION FROM AUDIO SIGNALS

(71) Applicants: Mark F. Bocko, Caledonia, NY (US); Sarah Smith, Rochester, NY (US)

(72) Inventors: Mark F. Bocko, Caledonia, NY (US); Sarah Smith, Rochester, NY (US)

(73) Assignee: THE UNIVERSITY OF ROCHESTER, Rochester, NY (US)

( * ) Notice: Subject to any disclaimer, the term of this patent is extended or adjusted under 35 U.S.C. 154(b) by 101 days.

(21) Appl. No.: 15/255,366

(22) Filed: Sep. 2, 2016

(65) Prior Publication Data

US 2017/0061984 A1 Mar. 2, 2017

Related U.S. Application Data

(60) Provisional application No. 62/213,337, filed on Sep. 2, 2015.

(51) Int. Cl.
*G10L 19/00* (2013.01)
*G10L 21/0264* (2013.01)
(Continued)

(52) U.S. Cl.
CPC ..... *G10L 21/0264* (2013.01); *G10L 21/0208* (2013.01); *G10L 21/0232* (2013.01);
(Continued)

(58) Field of Classification Search
None
See application file for complete search history.

(56) References Cited

U.S. PATENT DOCUMENTS 7,039,581 B1 * 5/2006 Stachurski ..... G10L 19/20 704/205
8,219,390 B1 * 7/2012 Laroche ..... G10L 21/0272 704/207

(Continued)

OTHER PUBLICATIONS

T. Prego et al., "On the enhancement of dereverberation algorithms based on a perceptual evaluation criterion", ISCA 2013, pp. 1360-1363, Aug. 25-29, 2013.*

(Continued)

*Primary Examiner* — Richard Z Zhu
(74) *Attorney, Agent, or Firm* — Meunier Carlin & Curfman LLC

(57) ABSTRACT

Disclosed herein are systems and methods for removing reverberation from signals. The systems and methods can be applicable to audio signals, for example, to voice, musical instrument sounds, and the like. Signals such as the vowel sounds in speech and the sustained portions of many musical instrument sounds can be composed of a fundamental frequency component and a series of harmonically related overtones. The systems and methods can exploit the intrinsically high degree of mutual correlation among the overtones. When such signals are passed through a reverberant channel, the degree of mutual correlation among the partials can be reduced. An inverse channel filter for the removal of reverberation can be found by employing an adaptive filter technique that maximizes the cross-correlation among signal overtones.

20 Claims, 11 Drawing Sheets
(4 of 11 Drawing Sheet(s) Filed in Color)

(51) Int. Cl.

| | |
|---|---|
| ***G10L 21/0232*** | (2013.01) |
| ***G10L 21/0208*** | (2013.01) |
| *G10L 25/06* | (2013.01) |
| *G10L 19/008* | (2013.01) |
| *G10H 3/12* | (2006.01) |

(52) U.S. Cl.
CPC ..... *G10H 3/125* (2013.01); *G10L 19/008* (2013.01); *G10L 25/06* (2013.01); *G10L 2021/02082* (2013.01)

(56) References Cited

U.S. PATENT DOCUMENTS

| | | | | |
|---|---|---|---|---|
| 9,369,818 | B2 * | 6/2016 | Xiang | H04S 7/305 |
| 9,431,023 | B2 * | 8/2016 | Avendano | G10L 21/0272 |
| 2007/0185708 | A1 * | 8/2007 | Manjunath | G10L 19/097 704/207 |
| 2008/0059157 | A1 * | 3/2008 | Fukuda | 704/211 |
| 2009/0110207 | A1 * | 4/2009 | Nakatani | 381/66 |
| 2010/0142327 | A1 * | 6/2010 | Kepesi | G01S 3/786 367/124 |
| 2013/0182862 | A1 * | 7/2013 | Disch | G10H 1/08 381/61 |
| 2016/0309042 | A1 * | 10/2016 | Kechichian | H04M 9/085 |

OTHER PUBLICATIONS

Anderson et al., "Transient Response of Flat-Panel Distributed Mode Loudspeakers," 167th meeting of the Acoustical Society of America, Providence, RI, 2014, 5aSA3, paragraph 9:30.

Anderson et al., "Measuring Speech Intelligibility Loss in Single-Driver Panel" Audio Engineering Society Convention e-Brief 228 Presented at the 139th Convention Oct. 29-Nov. 1, 2015, New York, USA, 4 pages.

Anderson et al., "A Model for the Impulse Response of Distributed-Mode Loudspeakers and Multi-Actuator Panels," submitted to the 139th Convention of the AES, New York, Oct. 29-Nov. 1, 2015, 10 pages.

Angus, "Distributed Mode Loudspeaker Polar Patterns," presented at the 107th convention of the AES. New York, NY, USA, Sep. 24-27, 1999, 21 pages.

Boll, et al., "Suppression of acoustic noise in speech using spectral subtraction", Acoustics, Speech and Signal Processing, IEEE Transactions on 27.2 (1979), 113-120.

Bank et al., "The Distributed-Mode Loudspeaker—Theory and Practice," presented at the UK 13th Conference of the AES: Microphones and Loudspeakers. Mar. 1998, 129-135.

Boone "Multi-Actuator Panels (MAPs) as Loudspeaker Arrays for Wave Field Synthesis," J. Audio Eng. Soc., vol. 52, No. 7/8, Jul./Aug. 2004, 12 pages.

Elko, et al., "Microphone array systems for hands-free telecommunication", Speech Communication 20.3 (1996), 229-240.

Gillespie, et al., "Speech dereverberation via maximum-kurtosis sub-band adaptive filtering", IEEE International Conference on, vol. 6. IEEE, (2001), 4 pages.

Harris et al., "Spatial Bandwidth of Diffuse Radiation in Distributed-Mode Loudspeakers," presented at the 111th Convention of the AES. New York, NY, USA, Sep. 21-24, 2001, 5 pages.

Kawahara et al., "Modal Analysis and sound field simulation of vibration panels in a free sound field and in a rectangular enclosure," presented at the 130th convention of the AES. London, UK, May 13-16, 2011, 7 pages.

Kinoshita, et al., Spectral subtraction steered by multi-step forward linear prediction for single channel speech dereverberation, IEEE International Conference on. vol. 1. (2006), 817-820.

Lebart, et al., "A new method based on spectral subtraction for speech dereverberation", Acta Acustica united with Acustica 87.3 (2001), 359-366.

Marques, et al., "On the Necessary Delay for the Design of Causal and Stable Recursive Inverse Filters for Loudspeaker Equalization", Audio Engineering Society Convention 125. Audio Engineering Society, (2008), 8 pages.

Miyoshi, et al., "Inverse filtering of room acoustics", Acoustics, Speech and Signal Processing, IEEE Transactions on 36.2 (1988), 145-152.

Mosayyebpour, et al., "Single-microphone LP residual skewness-based inverse filtering of the room impulse response", Audio, Speech, and Language Processing, IEEE Transactions on 20.5 (2012), 1617-1632.

Naylor, et al. "Speech Dereverberation", Springer Science & Business Media, (2010), 4 pages.

New Transducers Limited, "NXT Technology Review.01", (2002), 32 pages.

Newhall, et al., "A technique for finding approximate inverse systems and its applications to equalization", Communication Technology, IEEE Transactions on 19.6 (1971), 1116-1127.

Radlovic et al. "Nonminimum-Phase Equalization and Its subjective Importance in Room Acoustics," IEEE Transactions on Speech and Audio Processing, vol. 8, No. 6, (2000), 10 pages.

Subramaniam, et al., "Cepstrum-based deconvolution for speech dereverberation", Speech and Audio Processing, IEEE Transactions on 4.5 (1996), 392-396.

Tech Note: Understanding Exciters—Principles and Applications. Dayton Audio, (2014), 8 pages.

Yegnanarayana, et al., "Enhancement of reverberant speech using LP residual signal", Speech and Audio Processing, IEEE Transactions on 8.3 (2000), 267-281.

Zhang, et al., "Adaptive inverse filtering of room acoustics", Signals, Systems and Computers, 2008 42nd Asilomar Conference on, IEEE, (2008), 788-792.

* cited by examiner

SYSTEMS AND METHODS FOR REMOVING REVERBERATION FROM AUDIO SIGNALS

CROSS-REFERENCE TO RELATED APPLICATION

This application claims benefit of and priority to U.S. Provisional Patent Application Ser. No. 62/213,337 file Sep. 2, 2015, which is fully incorporated by reference and made a part hereof.

BACKGROUND

As teleconferencing and mobile communication technologies have become more widespread, the delivery of optimal sound quality in such systems has been the subject of much research. In these applications, secondary noise sources and effects of the acoustic environment can degrade the quality of the transmitted speech. In general, the problem of speech enhancement for communication can be at least divided into three distinct, but related, tasks: noise suppression, echo cancellation, and dereverberation. In each case, the goal may be to enhance speech intelligibility. While attempts have been made to develop algorithms for the task of dereverberation, it may be likely that a different approach may be required.

One approach in dereverberation can be to filter a signal with some approximation of the inverse filter of the acoustic space in which the audio was recorded. This can work nearly exactly if the acoustic space impulse response can be both known in advance and is minimum phase. In practice, however, it is unlikely that these conditions will be met. It also may be rare that one has access to an impulse response measurement, and even when an impulse response is available, it seldom is minimum phase. It may, therefore, require some form of approximation to be made in estimating the inverse filter.

There is a class of methods that make use of multiple microphones to accomplish dereverberation. When recordings from multiple microphones distributed in an acoustic space are available, a degree of reverberation removal can be accomplished by identifying the direction of arrival of the direct signal and interfering signals coming from other directions. However, multiple microphone recordings may rarely be available.

The reduction of outside noise sources often may be achieved by spectral subtraction methods. These methods may rely on an estimate of the background noise spectrum gathered during a pause in audio activity and a subtraction of the noise spectrum from the spectrum of the reverberant recording. This may work for the case of stationary broadband noise. In contrast, interference from reverberation can be both time varying and dependent upon the preceding source audio signal, possibly making such noise reduction algorithms less suited to the task of dereverberation.

Existing methods may employ a statistical model for reverberation, allowing the reverberant spectrum to be estimated based on the past audio data. This statistical model corresponds most accurately to the dense reflections encountered in the late reverberant field, as opposed to the sparse, more prominent echoes of early reverberation. Additionally, since spectral subtraction methods may modify only the amplitude spectrum of the signal and may need to use the original phases for reconstruction, they may not be capable of perfect signal reconstruction.

In recent years, attention has been focused on developing speech dereverberation techniques based on parameters of the expected clean audio. In particular, some approaches use a linear prediction model of speech. By processing the recorded sound to remove the filtering of the vocal tract, the remaining residual signal can be viewed as an approximation of the glottal pulse waveform. In clean speech, this waveform can be impulsive in nature, with short duration, high amplitude pulses followed by intervals of low amplitude. However, this amplitude distribution can be smeared in noisy or reverberant speech. Therefore, it is possible to develop a filtering method designed to optimize some statistic of the linear prediction residual. Common examples can include maximizing the skew or kurtosis, or minimizing the associated entropy. While the spectral subtraction methods make assumptions about the nature of the reverberation, the linear predictive modeling methods may instead restrict the model of the source data. As such, these methods depend upon the source being a single speaker, or else they may require that source separation be performed beforehand.

Therefore, what are needed are devices, systems and methods that overcome challenges in the present art, some of which are described above.

SUMMARY

The systems and method disclosed herein can rely on a consequence of the physics of sound production in speech and music, namely, that there can be an intrinsically high degree of correlation among the harmonically related partials in the quasi-periodic intervals of an audio stream. This can be verified by measurements on recordings made in anechoic conditions. The presence of reverberation reduces the observed correlations among the overtone partials in the signal. An adaptive filtering method that seeks to restore the correlations among the spectral overtones can be used to create an inverse filter for removing channel reverberation. Many different optimization methods to find the coefficients of the adaptive filter may be employed, the systems and methods described are independent of the method of optimization.

In one aspect of the disclosure, a method for the removal of reverberation from a signal is described. The method can include: tracking overtones of the signal; determining cross-correlations of the overtones of the signal; determining an error associated with the cross-correlations of the overtones of the signal; removing reverberation from the signal by filtering the signal based on the determined error to maximize the cross correlations of the overtones, and sending the signal to one or more systems. The one or more systems can include a loudspeaker.

The signal can be periodic or quasi-periodic. The signal can include a digital signal, an analog signal, or a partially digital, partially analog signal. The signal can be an audio signal. The signal can be pre-recorded or live. The signal can include one or more of speech and music.

In one aspect, an adaptive filter can be used for the removal of reverberation from the signal.

Determining the error associated with the cross-correlations of the overtones of the signal can be performed from the cross-correlations among the overtone signal components with an adaptive-filter tuning scheme. Maximizing cross-correlations of the overtones based on the error can be performed by adjusting one or more coefficients of the adaptive filter. Tracking the overtones of the signal can include determining the instantaneous frequency and amplitude of the overtones of the signal. Determining the cross-correlation of the overtones of the signal can be in the analog domain, the digital domain, or a partially analog, partially digital domain.

In one aspect, tracking the overtones of the signal can involve isolating the overtones using a bank of filters. The bank of filters can comprise lowpass, highpass, or bandpass filters. The bank of filters can be analog, digital, or partially analog, partially digital. Moreover, isolating the overtones of the signal can be performed by a heterodyne detection method. Alternatively, multiple overtones can be tracked simultaneously using a Short Time Fourier Transform or similar method without first isolating the overtones.

In another aspect of the disclosure, a system for the removal of reverberation from a signal is described. The system can include: memory containing computer-executable instructions; a processor in communication with the memory, wherein the processor executes the computer-readable instructions. Furthermore, the instructions can cause the processor to: track overtones of the signal; determine cross-correlations of the overtones of the signal; determine an error associated with the cross-correlations of the overtones of the signal; remove reverberation from the signal by filtering the signal based on the determined error to maximize the cross correlations of the overtones, and send the signal to one or more systems.

The signal can be periodic or quasi-periodic. The signal can include a digital signal, an analog signal, or a partially digital, partially analog signal. The signal can be an audio signal. The signal can be pre-recorded or live. The signal can include one or more of speech and music.

In one aspect, an adaptive filter can be used for the removal reverberation from the signal.

In one aspect, determining the error can be performed from the cross-correlations among the overtone signal components with an adaptive filter tuning scheme. Maximizing cross-correlations of the overtones based on the error can be performed by adjusting one or more coefficients of the adaptive filter. Tracking the overtones of the signal can include determining the instantaneous frequency and amplitude of the overtones of the signal. Determining the cross-correlation of the overtones of the signal can be in an analog domain, a digital domain, or a partially analog, partially digital domain. The reverberation filter can be implemented as analog, digital, or partially analog partially digital.

In one aspect, tracking the overtones of the signal can involve isolating the overtones using a bank of filters. The bank of filters can comprise lowpass, highpass, or bandpass filters. The bank of filters can be analog, digital, or partially analog, partially digital. Moreover, isolating the overtones of the signal can be performed by a heterodyne detection method. Alternatively, multiple overtones can be tracked simultaneously using a short-time Fourier transform or similar method without first isolating the overtones.

Additional advantages will be set forth in part in the description which follows or may be learned by practice. The advantages will be realized and attained by means of the elements and combinations particularly pointed out in the appended claims. It is to be understood that both the foregoing general description and the following detailed description are exemplary and explanatory only and are not restrictive, as claimed.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The accompanying drawings, which are incorporated in and constitute a part of this specification, illustrate embodiments and together with the description, serve to explain the principles of the methods and systems.

DETAILED DESCRIPTION

Figure 1:
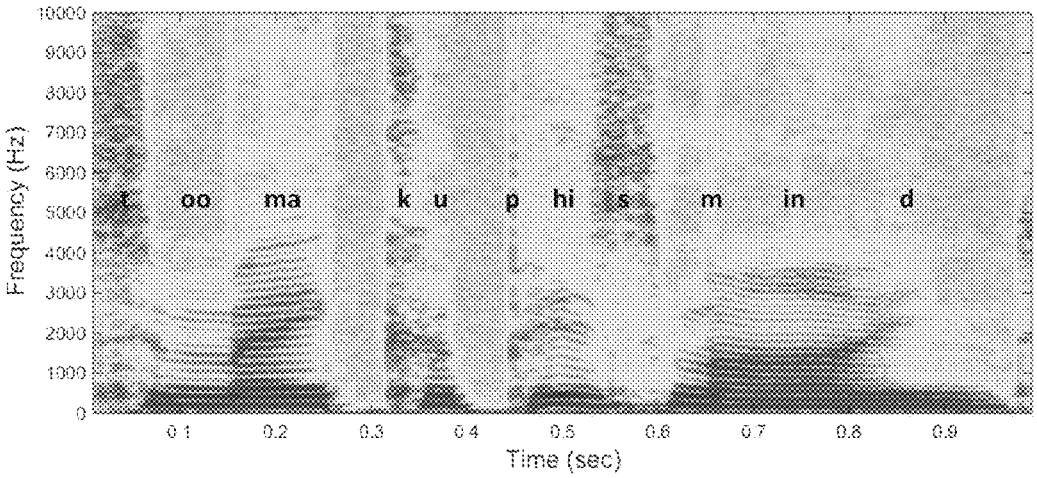
FIG. 1 shows a spectrogram of a recording of a short segment of female speech, "to make up his mind." During the vowel sounds, the spectrum exhibits a complex series of overtones that track the modulation of the fundamental frequency component in the spectrum.

Before the present methods and systems are disclosed and described, it is to be understood that the methods and systems are not limited to specific synthetic methods, specific components, or to particular compositions. It is also to be understood that the terminology used herein is for the purpose of describing particular embodiments only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The present methods and systems may be understood more readily by reference to the following detailed description of preferred embodiments and the Examples included therein and to the Figures and their previous and following description.

As will be appreciated by one skilled in the art, the methods and systems may take the form of an entirely hardware embodiment, an entirely software embodiment, or an embodiment combining software and hardware aspects. Furthermore, the methods and systems may take the form of a computer program product on a computer-readable storage medium having computer-readable program instructions (e.g., computer software) embodied in the storage medium. More particularly, the present methods and systems may take the form of web-implemented computer software. Any suitable computer-readable storage medium may be utilized including hard disks, CD-ROMs, optical storage devices, or magnetic storage devices.

Embodiments of the methods and systems are described below with reference to block diagrams and flowchart illustrations of methods, systems, apparatuses and computer program products. It will be understood that each block of the block diagrams and flowchart illustrations, and combinations of blocks in the block diagrams and flowchart illustrations, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create a means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including computer-readable instructions for implementing the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions specified in the flowchart block or blocks.

Accordingly, blocks of the block diagrams and flowchart illustrations support combinations of means for performing the specified functions, combinations of steps for performing the specified functions and program instruction means for performing the specified functions. It will also be understood that each block of the block diagrams and flowchart illustrations, and combinations of blocks in the block diagrams and flowchart illustrations, can be implemented by special purpose hardware-based computer systems that perform the specified functions or steps, or combinations of special purpose hardware and computer instructions.

A large class of audio signals produced by acoustic resonators and oscillators, such as speech and many musical instruments sounds, can exhibit a high degree of correlation among their harmonically related spectral components. For example, the vowel portions of a speech stream can display a spectrum with a fundamental frequency component plus a series of overtone partials that can be harmonically related to the fundamental frequency, i.e., the overtone frequencies can be integer multiples of the fundamental frequency. In this case the partials can be called "overtones' of the fundamental. The same can be true of a broad class of musical instrument sounds, especially wind instruments—both woodwinds and brass wind instruments—and bowed, plucked and struck string instruments such as the violin, guitar, and piano, although slight detuning of the overtones from a strict integer ratios can exist in the latter instances.

A high degree of mutual correlation can be seen among the overtones comprising such signals. Typically, the fundamental of such periodic audio signals can display some degree of frequency and amplitude modulation. The modulation characteristics of the overtones may be closely related to those of the fundamental. The fundamental and overtones can be produced by a common resonant system, such as a vocal tract or an air column or string in a musical instrument, and the observed modulation can result from changes in either the signal driving the resonant system or in the boundary conditions of the resonant system, such as the length of a string or the shape of a vocal tract. As an example, FIG. 1 shows a spectrogram of a short segment of speech; a female speaker saying, "to make up his mind" recorded in an anechoic space, i.e., a space where there are no echoes or reverberation.

Examining the above spectrogram at approximately t=0.1 second, which corresponds to the "oo" sound in the word "to", a fundamental and an overtone series that can simultaneously sweep downward in frequency can be apparent, and at approximately t=0.2 seconds an upward sweep during the long 'a' sound of the word "make" can be observed. More rapid frequency modulation of the fundamental and harmonic overtone series can be observed throughout, this may be especially apparent in the interval (approximately 0.65 sec to approximately 0.8 sec) for the "i" sound in the word "mind".

Various methods may be used to track the instantaneous frequency and amplitude of the individual spectral components of such signals. In one aspect of the methods and systems disclosed herein, an adaptive narrow band filter bank can be used to isolate each harmonic component of the signal; this can be followed by a determination of the instantaneous frequency and amplitude versus time for each overtone. This may be accomplished using, for example, a Short Time Fourier Transform (STFT) based method or with the Hilbert transform. Alternatively, multiple overtones can be tracked simultaneously using STFT or similar method without first isolating the overtones. FIG. 2 shows the tracking results for an anechoic recording of the word "mind" taken from the recording displayed in FIG. 1.

Figure 2:
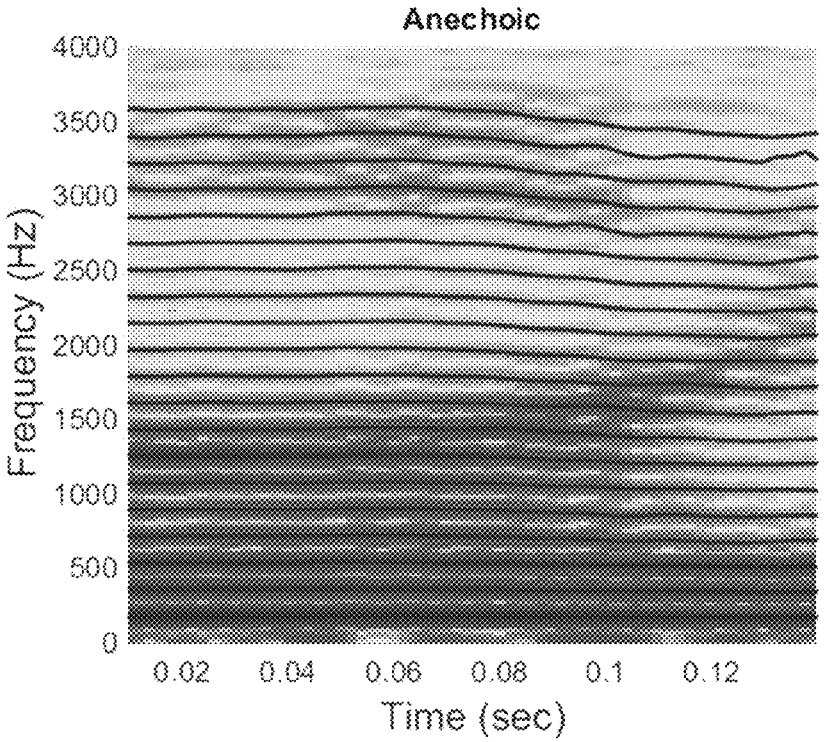
FIG. 2 shows the tracking of the overtone partials in a sample of speech—the long 'i' in the word "mind." The first 20 partials can be followed in this example.
Figure 3:
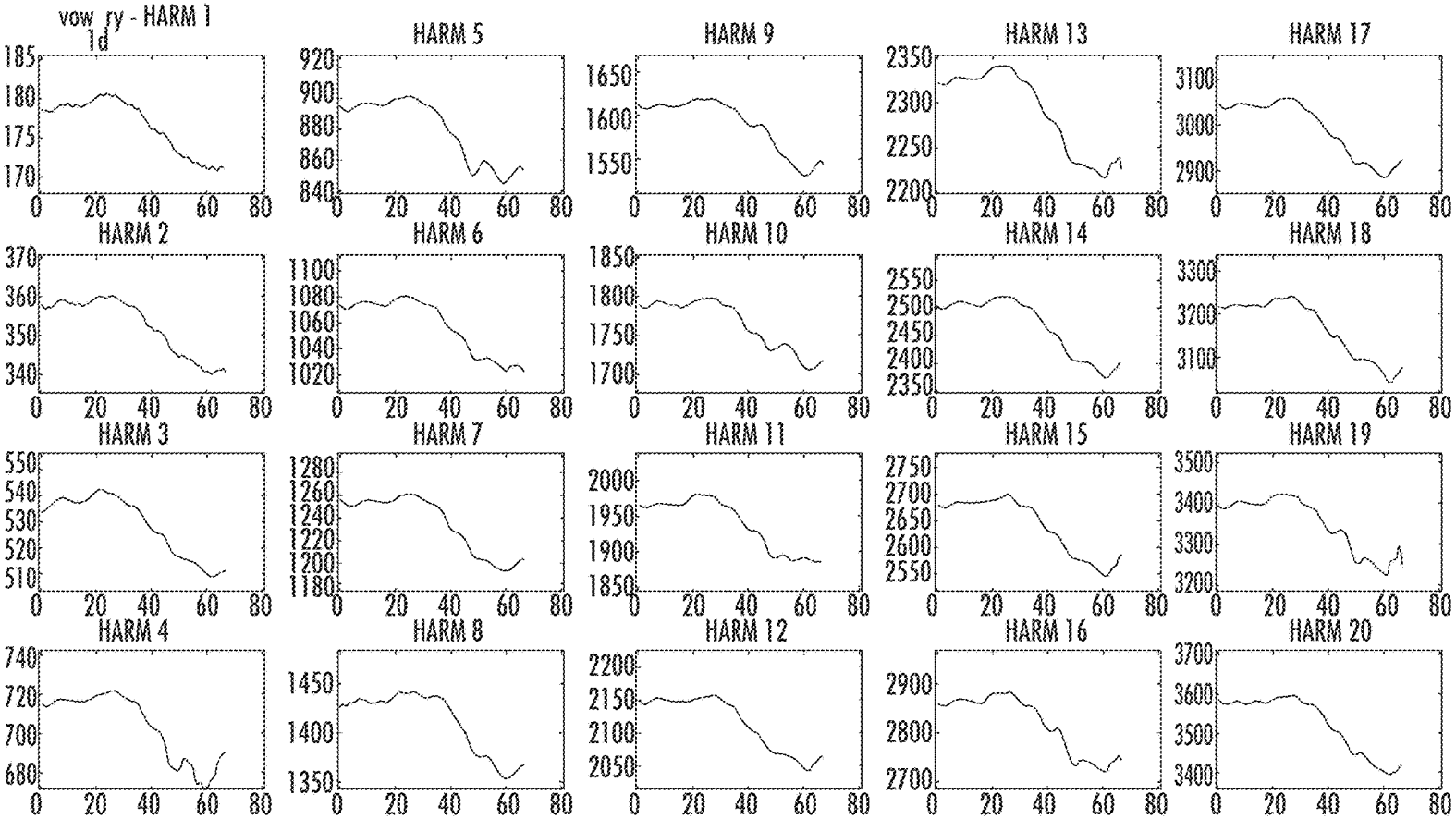
FIG. 3 shows the instantaneous frequency tracks of the first 20 overtones of the long 'i' speech sound.

Tracking each overtone and expanding the frequency scale can make the instantaneous frequencies of the overtones more apparent, as shown in FIG. 3, which displays the frequency trajectories for the 20 lowest frequency components in the spectrogram of FIG. 1.

Figure 4:
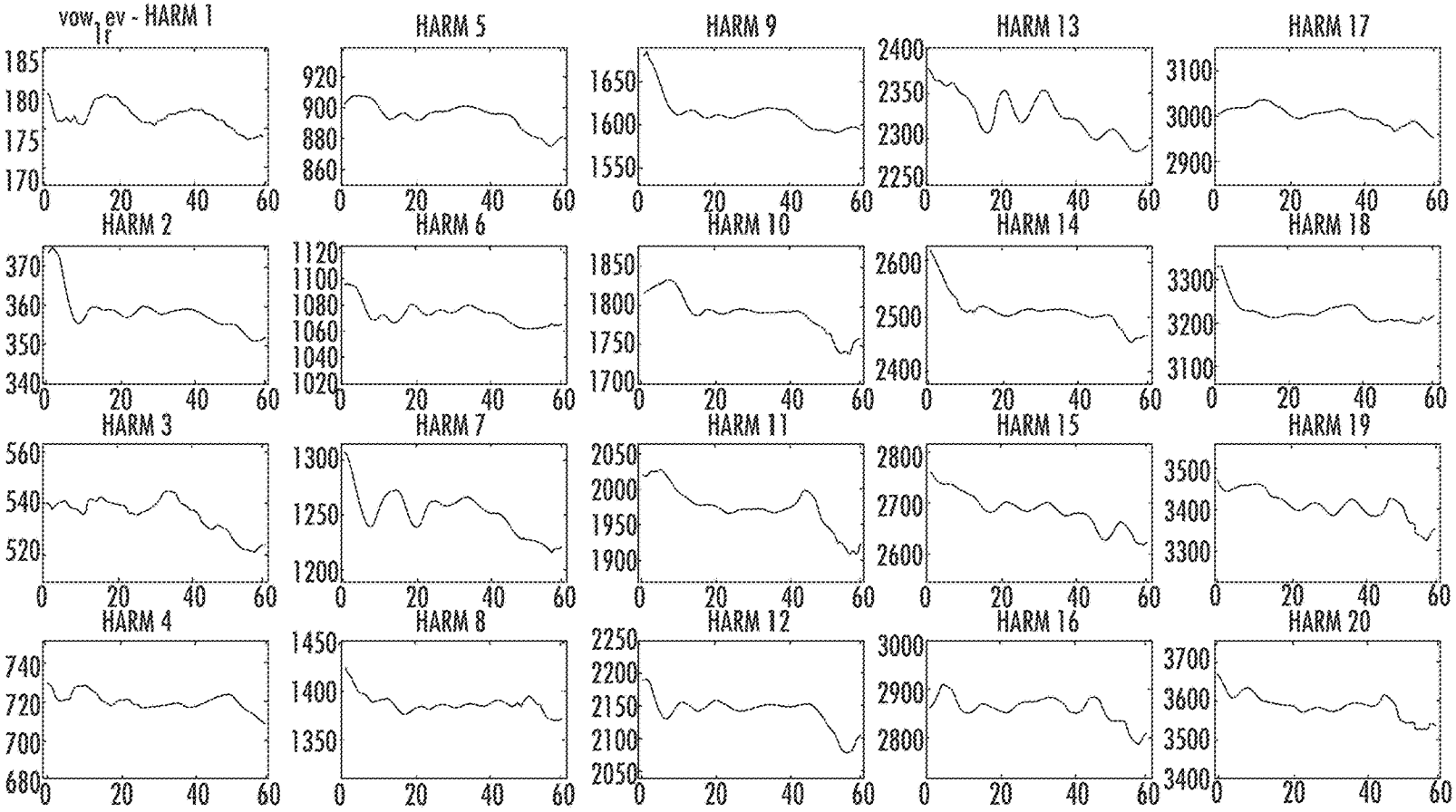
FIG. 4 shows overtone-tracking results for the signal analyzed in FIG. 3 with a moderate degree of reverberation present. The speech is still clearly understandable to a human listener.

When the same speech signal is passed through a reverberant channel the instantaneous frequency tracks can display less similarity. FIG. 4 shows the tracking results for the same signal passed through a reverberant channel, implemented as a Schroeder digital reverberation filter.

To quantify this observation, FIG. 5 shows the cross-correlation among the overtone frequency tracks displayed in FIGS. 3 and 4. For two real-valued random variables of length N, $X_j(n)$ and $X_k(n)$ representing the frequency tracks of the $j'^{th}$ and $k'^{th}$ overtones, the correlation function can be defined by, $$R_{x_j x_k}(m) = \sum_{n=0}^{N-m-1} X_j(n+m)X_k(n)$$

where m is the lag. For zero time lag this can be reduced to a simpler expression:

$$R_{X_j X_k}(0)=\Sigma_{n=0}^{N-z} X_j(n)X_k(n).$$

In practice, the mean values of the frequency for each track can be subtracted from the instantaneous frequency tracks before computing the correlations and the cross correlation can be normalized by dividing by the product of the standard deviations of the two random variables. When the means are removed and the correlation is normalized in this manner, the zero lag cross correlation can be equal to the Pearson Correlation Coefficient and can be calculated using the covariance of the two tracks.

Figure 5A:
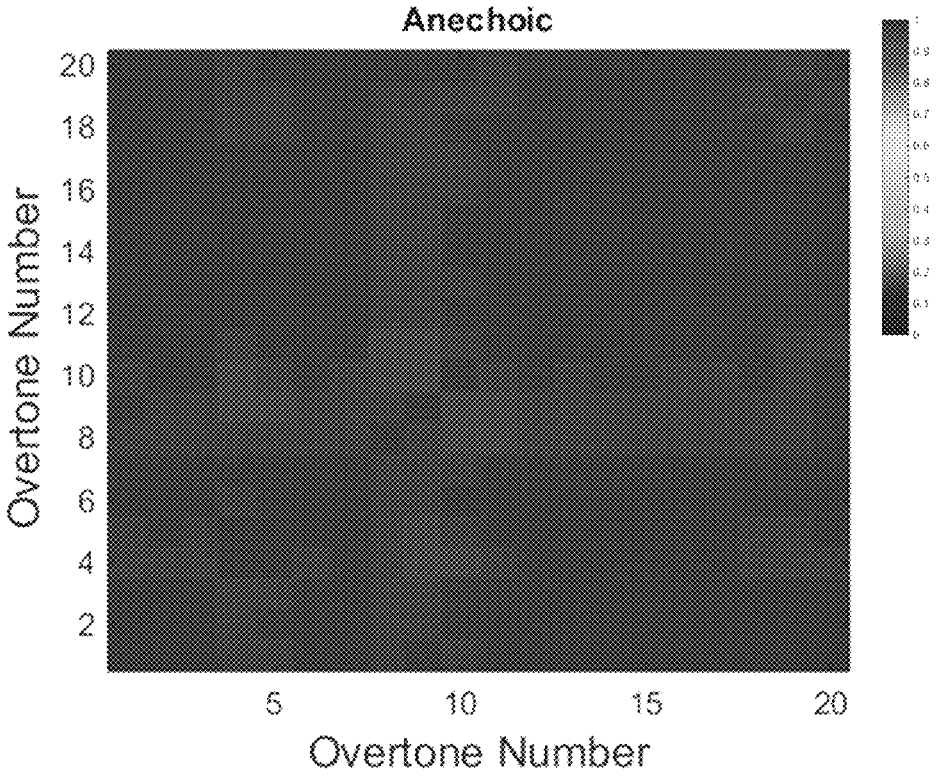
FIGS. 5A and 5B show the cross correlation function for the instantaneous frequency tracks of anechoic and reverberant examples of the vowel sound 'i' in the word mind. The color indicates the value of the cross correlation; note that the diagonal indicates perfect correlation because clearly, each overtone is perfectly correlated with itself.
Figure 5B:
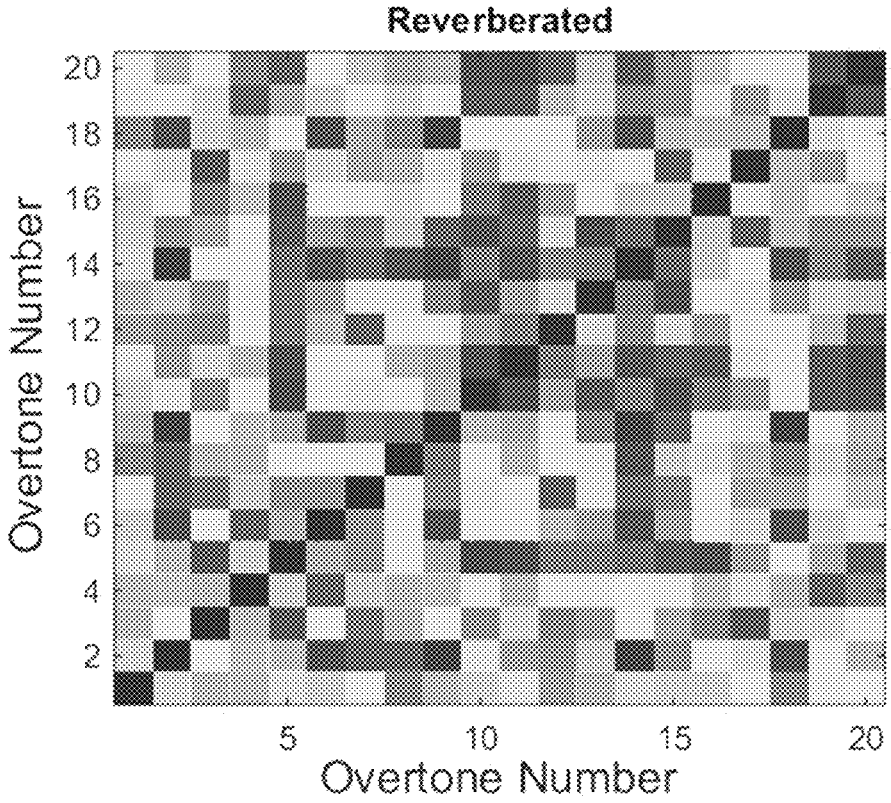

In FIG. 5A, the zero-lag cross-correlations for the anechoic recording of the long 'i' sound is shown, and in FIG. 5B, the cross-correlations in the presence of reverberation is shown.

Figure 6:
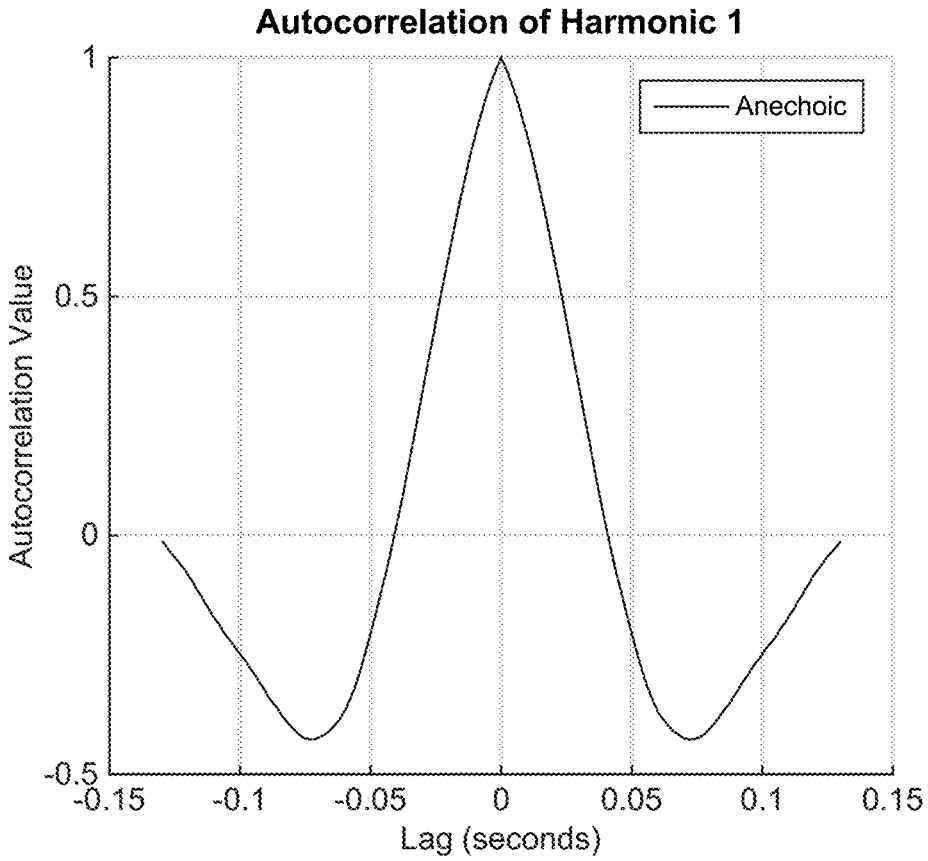
FIG. 6 is an illustration showing the autocorrelation function as a function of time lag is displayed for the first harmonic of the long 'i' vowel sound.

In the anechoic recording (FIG. 5A), a high degree of correlation may be observed. For example, it can be above about 0.95 for all partial pairings out to the approximately $20^{th}$ overtone. However, when moderate reverberation is present, the measured cross-correlations may decrease significantly, as shown in FIG. 5B. This can occur for the following reason: When the autocorrelation function of a single harmonic is plotted as a function of time lag, a peak at zero delay and a rather rapid fall-off versus delay is observed, as shown in FIG. 6. Note that the autocorrelation becomes negative for a lag of 0.07 seconds, which is one-half the period of the primary frequency modulation of the partial, but that the autocorrelation approaches zero as the delay is increased further. In an anechoic environment the recorded audio can be entirely direct sound and the intrinsically high degree of inter-partial cross correlations can be persevered. On the other hand, in a reverberant environment the received audio signal can be composed of the direct sound field and the reverberant field. The reverberant sound field can consist of a superposition of replicas of the original direct sound with varying amounts of delay. It is also possible that the reverberation time can be a function of frequency, in which case the various overtones can be composed of different proportions of direct and delayed sound. In this case, the frequency tracking of each overtone is affected by the delayed signal components in different ways, leading to the observed reduction in overtone correlation. Therefore, the zero-lag cross correlations among overtones may be expected to decrease when the reverberant sound field is large in comparison to the direct sound field.

Figure 7:
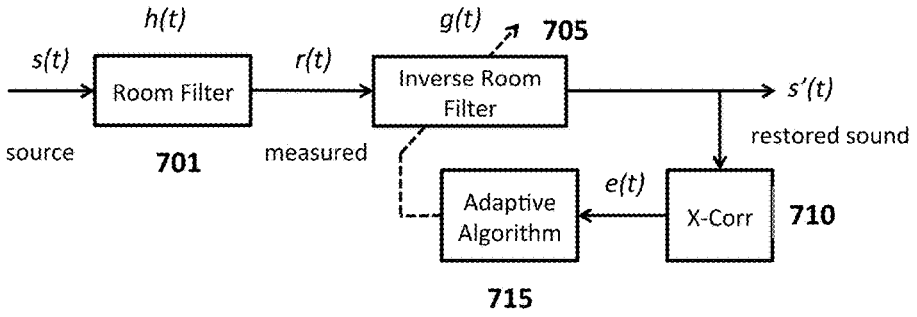
FIG. 7 shows a diagram of an exemplary adaptive filter to determine an inverse room filter to cancel reverberation.

FIG. 7 shows a diagram for an adaptive filter that converges to an inverse filter that can compensate for a given reverberant space, as can be characterized by the room filter 701. An anechoic source signal, s(t), can be passed through a room filter 701 with impulse response h(t) to produce the measured sound field r(t), which can be a combination of direct and reverberant sound fields. Moreover, the signal can be periodic or quasi periodic. The signal can include a digital signal, an analog signal, or a partially digital, partially analog signal. The signal can be an audio signal. The signal can be pre-recorded or live. The signal can include one or more of speech and music. The goal can be to find an approximation of the inverse room response filter 705, g(t), that restores the original signal. The parameters of the inverse room filter can be tuned in an adaptive algorithm 715 that seeks to maximize the cross correlations among the overtones. X-Corr 710 can represent the computation of the cross correlations among the overtones of the inverse-filtered sound, s'(t), and can generate an error signal, e(t), that can indicate the degree of deviation from perfect correlation among the overtone pairs.

Figure 8:
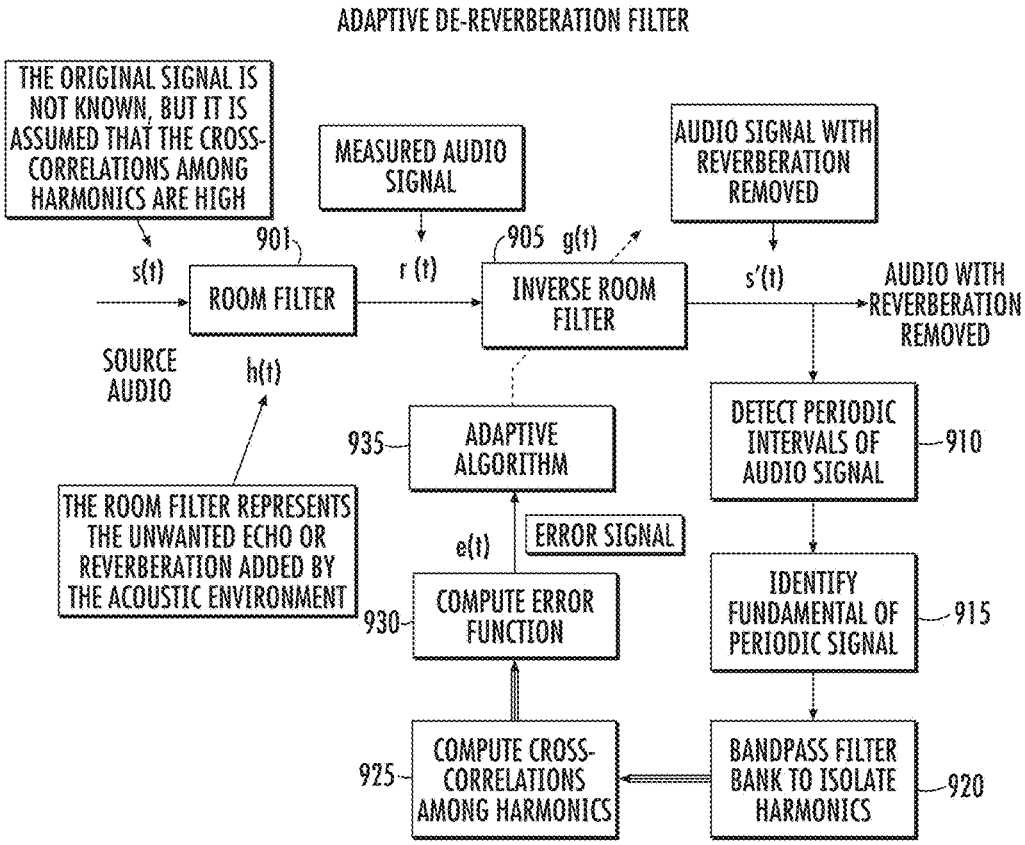
FIG. 8 shows a more detailed diagram of an exemplary adaptive filter to determine an inverse room filter to cancel reverberation.

FIG. 8 shows a diagram for an adaptive filter to find an inverse filter that can compensate for a given reverberant space in more detail than FIG. 7. Similar to FIG. 7, an anechoic source signal, s(t), can be passed through a room filter 901 with impulse response h(t) to produce the measured sound field r(t), which can be a combination of direct and reverberant sound fields. The goal may be to find an approximation of the inverse room response filter, g(t), that restores the original signal. Moreover, the signal can be periodic or quasi-periodic. The signal can include a digital signal, an analog signal, or a partially digital, partially analog signal. The signal can be an audio signal. The signal can be pre-recorded or live. The signal can include one or more of speech and music. The parameters of the inverse room filter 905 can be tuned in an adaptive algorithm that seeks to maximize the cross correlations among the overtones. X-Corr 710 in FIG. 7 has been replaced by 910-930. The quasi-periodic intervals of the signal with reverberation removed s'(t) can first be detected 910. The fundamental periodic signal of the signal can then be determined 915. Next a bandpass (or similar) filter bank can process the signal to isolate the overtones of the signal 920. The isolating the overtones of the signal can be performed by a bank of filters. The bank of filters comprise lowpass, highpass, or bandpass filters. The bank of filters can be analog, digital, or partially analog, partially digital. Moreover, the tracking of the overtones of the signal can be performed by a heterodyne detection method. Alternatively, multiple overtones can be tracked simultaneously using STFT or similar method without first isolating the overtones. Then the cross-correlations among the overtones can then be computed 926. The determination of the cross-correlation of the overtones of the signal can be in the analog domain, a digital domain, or a partially analog, partially digital domain. An error signal that can indicate the degree of deviation from perfect correlation among the overtone pairs can then be computed 930. The error signal can then be fed into an adaptive algorithm in 935. One or more of the coefficients of the adaptive filter can be adjusted based on various optimization methods.

Since individual parameters of the adaptive filter may affect the frequency content of the signal in different ways, the parameter adjustments can be chosen to preferentially adjust the overtones which are less correlated, while preserving components of the signal that display high correlation. Under the influence of the feedback from the "Adaptive Algorithm" 935 the "Inverse Room Filter" 905 converges to a set of filter coefficients that when applied to r(t) give the de-reverberated audio signal, s'(t).

One of the primary challenges faced by dereverberation technologies is the fact that many acoustic spaces, especially those with a level of reverberation that is large enough to reduce speech intelligibility significantly, may be non-minimum phase. Systems that are causal and stable whose inverses are causal and unstable can be referred to as non-minimum-phase systems. In this case, it may not be possible to simply invert the acoustic transfer function to find a stable and causal inverse filter. However, alternate methods exist to find an inverse filter, which may require the addition of extra delay to the filter.

The non-minimum phase behavior be understood intuitively by considering the "reverberation radius" for a source in an acoustic space. It can be defined as the distance from the source at which the direct and the reverberant acoustic sound pressure levels are equal. When the reverberation radius lies within any part of an acoustic enclosure it is possible for the system to become non-minimum phase, in particular, when the receiving microphone is placed outside of the radius of reverberation for the source. In one aspect of the disclosure, the reverberant sound field can be large enough to reduce speech intelligibility, and can furthermore correspond to room responses that are non-minimum phase.

It bears repeating that while many different optimization methods to find the coefficients of the adaptive filter may be employed, the adaptive system described is independent of the specific method of optimization. Moreover, the adaptive methods can employ feedback, while the optimization methods can be considered a subset of the adaptive methods. Many alternative optimization methods may be employed such as gradient search, Newton's method, Lagrangian methods, linear, quadratic and nonlinear programming, stochastic search, genetic algorithms, projection onto convex sets, and the like. The systems and methods disclosed herein are not limited to these methods.

Finding approximate inverses for a non-minimum phase system has been previously researched. In general, the z-domain response, H(z), for a system consisting of an acoustic source and a detector placed in an acoustic space can have both zeros and poles. The poles lie within the unit circle in the z-plane if the system is stable but the zeros may lie anywhere in the z-plane. If any of the zeros lie outside of the unit circle then the system can be said to be non-minimum phase.

If an independent measurement of the original system impulse response is available, the inverse can be defined as the filter that can reconstruct an impulse when applied to the system impulse response. In general the optimal inverse filter can be defined by a z domain response as G(z)=1/H(z), which can result in an overall response of G(z)H(z)=1 and can reconstruct the input exactly. The original response H(z) can be expressed as a ratio of two polynomials in z, with the zeros corresponding to the roots of the numerator and the poles corresponding to the roots of the denominator. As such, the poles of G(z) can correspond to the zeros of H(z) and the zeros of G(z) can correspond to the poles of H(z). However, in a non-minimum phase system, here is at least one zero outside of the unit circle and it is replaced with a pole then the resulting inverse filter will be unstable Thus, it may not be possible to construct a stable inverse for non-minimum phase systems, using this straightforward method. An alternative method for finding an inverse filter may be therefore be required.

Figure 9:
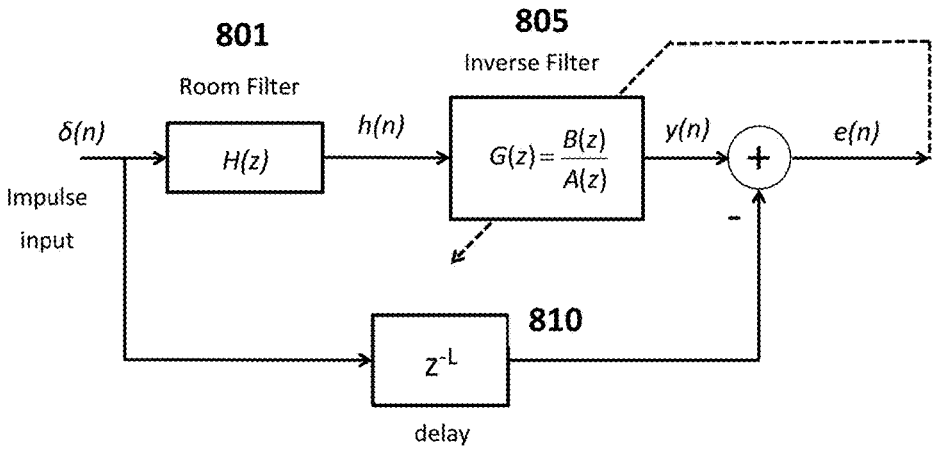
FIG. 9 shows a diagram of a way an inverse to a given room response can be found. An impulse is sent through a room filter, the output of which is passed through an inverse filter which when properly tuned will reproduce a delayed version of the input impulse.

In one aspect of the disclosure, the method is further expanded such that it is recast as a least-squares error minimization problem as shown in FIG. 9.

If the acoustic system response H(z) 801 is known, it can be possible to evaluate potential inverse filters 805 based on comparing y(n), the output of the reconstruction, to a potentially delayed version of the input delta function δ(n). Here the potential delay in samples can be noted by L. In the z domain, this delay 810 can be represented as a factor of $z^{-L}$, indicating its implementation in the z domain. The error signal can be defined as, $$e(n)=y(n)-\delta(n-L)$$

and an error function can be defined as the sum of the squares of e(n) over the entire sequence length. It can be computed as follows, $$E=\sum_{n=1}^{N} e(n)^2$$

It can then be minimized in a multidimensional search using standard methods. In practice the minimum error may be dependent upon the order of the inverse filter and a full exploration of the solution space may be computationally intensive.

However, in applications where a measurement of H(z) is unavailable, a new error function may be needed in order to perform the optimization. In another aspect of the disclosure, the zero-lag cross-correlation function for all pairs of overtones can form a symmetric matrix. A single scalar error function can be defined by summing the squares of the elements of the cross-correlation matrix and, after normalization, subtracting the result from unity. This quantity can then serve as the error function to be minimized.

Rather than simply using the polynomial coefficients of the filter numerator and denominator it may prove to be more efficient to employ a factored form of the transfer function and describe the function by its poles and zeros. Even more efficient parameterizations of the inverse filter may be possible, for instance it often can be found that the inverse filter contains groupings of zeros distributed on circles of given radii, which can be efficiently represented with far fewer parameters than the polynomial coefficients, or even the locations of the zeros and poles.

Because the cross-correlation matrix can contain information about how different frequencies can be affected by the room response, it may be more effective to employ a multidimensional error function and to selectively optimize the positions of the dominant poles or zeros near certain frequencies of concern.

Figure 10:
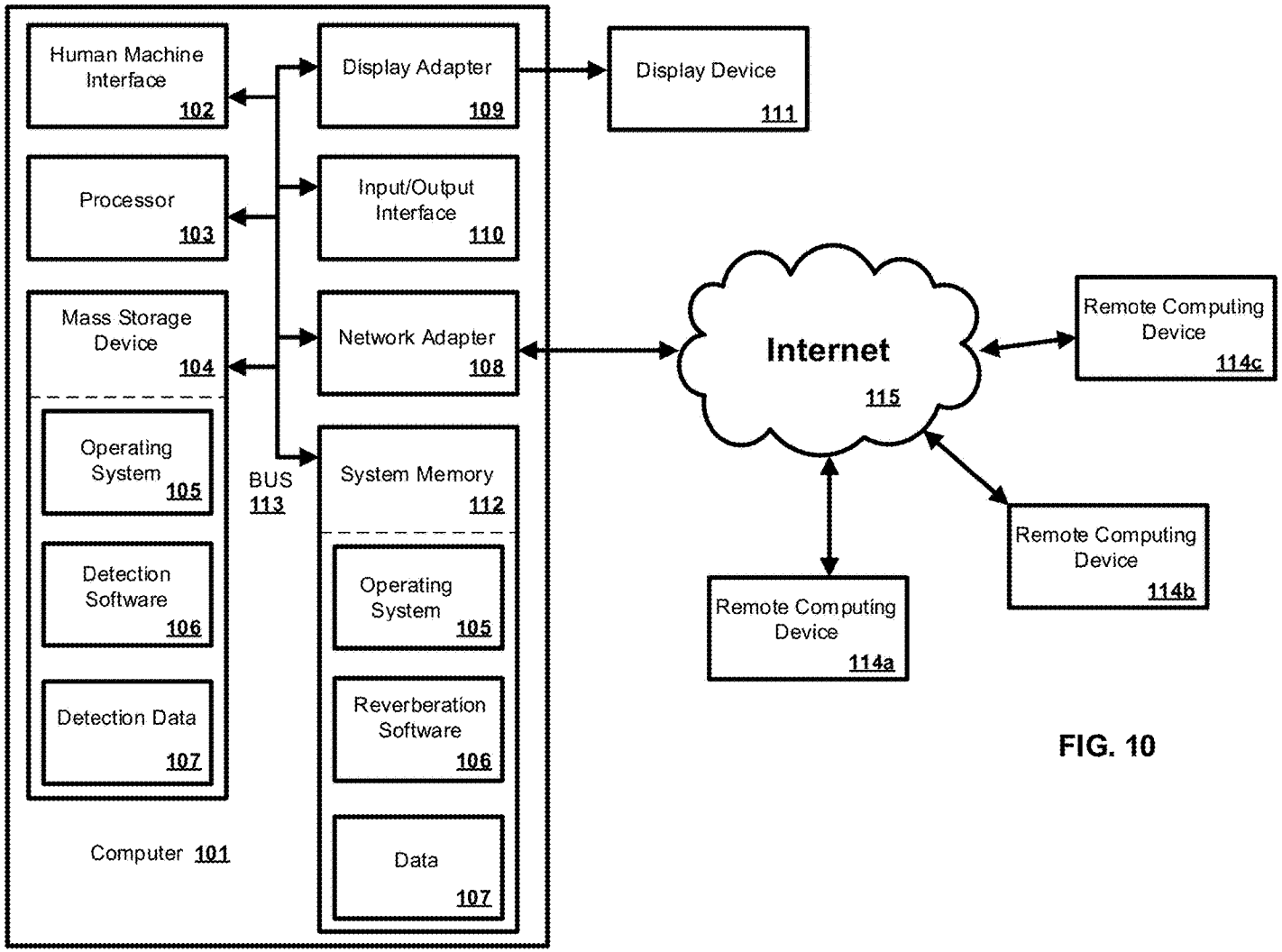
FIG. 10 shows a diagram of an example computational environment for implementing the disclosed systems and methods.

The system has been described above as comprised of units. One skilled in the art will appreciate that this is a functional description and that the respective functions can be performed by software, hardware, or a combination of software and hardware. A unit can be software, hardware, or a combination of software and hardware. The units can comprise the Reverberation Software 106 as illustrated in FIG. 10 and described below. In one exemplary aspect, the units can comprise a computer 101 as illustrated in FIG. 10 and described below.

FIG. 10 is a block diagram illustrating an exemplary operating environment for performing the disclosed methods. This exemplary operating environment is only an example of an operating environment and is not intended to suggest any limitation as to the scope of use or functionality of operating environment architecture. Neither should the operating environment be interpreted as having any dependency or requirement relating to any one or combination of components illustrated in the exemplary operating environment.

The present methods and systems can be operational with numerous other general purpose or special purpose computing system environments or configurations. Examples of well-known computing systems, environments, and/or configurations that can be suitable for use with the systems and methods comprise, but are not limited to, embedded signal processing computers, personal computers, server computers, laptop devices, and multiprocessor systems. Additional examples comprise programmable consumer electronics, teleconferencing devices, network PCs, minicomputers, mainframe computers, distributed computing environments that comprise any of the above systems or devices, and the like.

The processing of the disclosed methods and systems can be performed by software components, for example as a "plug-in" software module for a digital audio workstation. The disclosed systems and methods can be described in the general context of computer-executable instructions, such as program modules, being executed by one or more computers or other devices. Generally, program modules comprise computer code, routines, programs, objects, components, data structures, etc. that perform particular tasks or implement particular abstract data types. The disclosed methods can also be practiced in grid-based and distributed computing environments where tasks are performed by remote processing devices that are linked through a communications network. In a distributed computing environment, program modules can be located in both local and remote computer storage media including memory storage devices.

Further, one skilled in the art will appreciate that the systems and methods disclosed herein can be implemented via a general-purpose computing device in the form of a computer 101. The components of the computer 101 can comprise, but are not limited to, one or more processors or processing units 103, a system memory 112, and a system bus 113 that couples various system components including the processor 103 to the system memory 112. In the case of multiple processing units 103, the system can utilize parallel computing.

The system bus 113 represents one or more of several possible types of bus structures, including a memory bus or memory controller, a peripheral bus, an accelerated graphics port, and a processor or local bus using any of a variety of bus architectures. By way of example, such architectures can comprise an Industry Standard Architecture (ISA) bus, a Micro Channel Architecture (MCA) bus, an Enhanced ISA (EISA) bus, a Video Electronics Standards Association (VESA) local bus, an Accelerated Graphics Port (AGP) bus, and a Peripheral Component Interconnects (PCI), a PCI-Express bus, a Personal Computer Memory Card Industry Association (PCMCIA), Universal Serial Bus (USB) and the like. The bus 113, and all buses specified in this description can also be implemented over a wired or wireless network connection and each of the subsystems, including the processor 103, a mass storage device 104, an operating system 105, Reverberation software 106, data 107, a network adapter 108, system memory 112, an Input/Output Interface 110, a display adapter 109, a display device 111, and a human machine interface 102, can be contained within one or more remote computing devices 114*a,b,c* at physically separate locations, connected through buses of this form, in effect implementing a fully distributed system.

The computer 101 typically comprises a variety of computer readable media. Exemplary readable media can be any available media that is accessible by the computer 101 and comprises, for example and not meant to be limiting, both volatile and non-volatile media, removable and non-removable media. The system memory 112 comprises computer readable media in the form of volatile memory, such as random access memory (RAM), and/or non-volatile memory, such as read only memory (ROM). The system memory 112 typically contains data such as data 107 and/or program modules such as operating system 105 and reverberation software 106 that are immediately accessible to and/or are presently operated on by the processing unit 103.

In another aspect, the computer 101 can also comprise other removable/non-removable, volatile/non-volatile computer storage media. By way of example, FIG. 10 illustrates a mass storage device 104 which can provide non-volatile storage of computer code, computer readable instructions, data structures, program modules, and other data for the computer 101. For example and not meant to be limiting, a mass storage device 104 can be a hard disk, a removable magnetic disk, a removable optical disk, magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like.

Optionally, any number of program modules can be stored on the mass storage device 104, including by way of example, an operating system 105 and reverberation software 106. Each of the operating system 105 and Reverberation software 106 (or some combination thereof) can comprise elements of the programming and the Reverberation software 106. Data 107 can also be stored on the mass storage device 104. Data 107 can be stored in any of one or more databases known in the art. Examples of such databases comprise, DB2®, Microsoft® Access, Microsoft® SQL Server, Oracle®, mySQL, PostgreSQL, and the like. The databases can be centralized or distributed across multiple systems.

In another aspect, the user can enter commands and information into the computer 101 via an input device (not shown). Examples of such input devices comprise, but are not limited to, a keyboard, pointing device (e.g., a "mouse"), a microphone, a joystick, a scanner, tactile input devices such as gloves, and other body coverings, and the like These and other input devices can be connected to the processing unit 103 via a human machine interface 102 that is coupled to the system bus 113, but can be connected by other interface and bus structures, such as a parallel port, game port, an IEEE 1394 Port (also known as a Firewire port), a serial port, or a universal serial bus (USB).

In yet another aspect, a display device 111 can also be connected to the system bus 113 via an interface, such as a display adapter 109. It is contemplated that the computer 101 can have more than one display adapter 109 and the computer 101 can have more than one display device 111. For example, a display device can be a monitor, an LCD (Liquid Crystal Display), or a projector. In addition to the display device 111, other output peripheral devices can comprise components such as speakers (not shown) and a printer (not shown) which can be connected to the computer 101 via Input/Output Interface 110. Any step and/or result of the methods can be output in any form to an output device. Such output can be any form of visual representation, including, but not limited to, textual, graphical, animation, audio, tactile, and the like.

Optionally or alternatively, the computer 101 can operate in a networked environment using logical connections to one or more remote computing devices 114*a,b,c*. By way of example, a remote computing device can be a personal computer, portable computer, a server, a router, a network computer, a peer device or other common network node, and so on. Logical connections between the computer 101 and a remote computing device 114*a,b,c* can be made via a local area network (LAN) and a general wide area network (WAN). Such network connections can be through a network adapter 108. A network adapter 108 can be implemented in both wired and wireless environments. Such networking environments are conventional and commonplace in offices, enterprise-wide computer networks, intranets, and the Internet 115.

For purposes of illustration, application programs and other executable program components such as the operating system 105 are illustrated herein as discrete blocks, although it is recognized that such programs and components reside at various times in different storage components of the computing device 101, and are executed by the data processor(s) of the computer. An implementation of Reverberation software 106 can be stored on or transmitted across some form of computer readable media. Any of the disclosed methods can be performed by computer readable instructions embodied on computer readable media. Computer readable media can be any available media that can be accessed by a computer. By way of example and not meant to be limiting, computer readable media can comprise "computer storage media" and "communications media." "Computer storage media" comprise volatile and non-volatile, removable and non-removable media implemented in any methods or technology for storage of information such as computer readable instructions, data structures, program modules, or other data. Exemplary computer storage media comprises, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computer.

The methods and systems, including the adaptive methods and system, can employ Artificial Intelligence techniques such as machine learning and iterative learning. Examples of such techniques include, but are not limited to, expert systems, case based reasoning, Bayesian networks, behavior based AI, neural networks, fuzzy systems, evolutionary computation (e.g. genetic algorithms), swarm intelligence (e.g. ant algorithms), and hybrid intelligent systems (e.g. Expert inference rules generated through a neural network or production rules from statistical learning).

In one aspect of the disclosure, the systems and methods described herein can find application in a wide variety of audio recording and transmission protocols, devices, and systems where dereverberation is desirable.

The disclosed systems and methods can be used in the processing of audio data used in internet teleconferencing systems, such as systems for internet telephone conferencing, videoconferencing, web conferencing, augmented reality conferencing, and the like.

Moreover, the disclosed systems and methods can be used in the processing of audio data used in internet telephony where dereverberation is desirable. Internet telephony can involve conducting a teleconference over the Internet, LAN, WAN, and the like.

In another aspect of the disclosure, the systems and methods described herein can find application in the processing of audio data used in telecollaboration where dereverberation is desirable. Telecollaboration can refer to a set of software and hardware technologies that can enable the integration and extension of personal desktop collaboration into high definition teleconferencing and videoconferencing.

In another aspect, the systems and methods described herein can find application in the processing of audio data used in videoconferencing where dereverberation is desirable. Videoconferencing can moreover comprise dedicated systems, desktop systems, or WebRTC platforms. WebRTC can refer to video conferencing solutions that are not resident by using a software application but is available through a web browser. The audio input for videoconferencing can comprise: microphones, CD/DVD player, cassette player, and the like. The audio output can comprise usually loudspeakers associated with the display device or telephone, data transfer can comprise analog or digital telephone network, LAN or Internet; and a data processing unit that ties together the other components, does the compressing and decompressing, and initiates and maintains the data linkage via the network.

In another aspect of the disclosure, the systems and methods described herein can find application in the processing of audio data used in Voice over IP (VoIP) where dereverberation is desirable. VoIP can refer to a methodology and group of technologies for the delivery of voice communications and multimedia sessions over Internet Protocol (IP) networks, such as the Internet.

The systems and methods described herein can find application in the processing of audio data used in Mobile VoIP or mVoIP where dereverberation is desirable. mVoIP can refer to an extension of mobility to a Voice over IP network. Two types of communication can generally be supported: cordless/Digital Enhanced Cordless Telecommunications (DECT)/Personal Communications Service (PCS) protocols for short range or campus communications where all base stations are linked into the same LAN, and wider area communications using 3G/4G protocols and the like.

The systems and methods described herein can find application in the processing of audio data used in voice messaging and voice response systems which accept speech for caller input where dereverberation is desirable. Such system can use the disclosed systems and methods for dereverberation while speech prompts are played to prevent the systems' own speech recognition from falsely recognizing the prompts. Example application can include: hands-free car phone systems, a standard telephone or cellphone in speakerphone or hands-free mode, dedicated standalone conference phones, installed room systems which use ceiling speakers and microphones on the table, and physical coupling (vibrations of the loudspeaker transfer to the microphone via the handset casing).

In another aspect of the disclosure, the systems and methods described herein can find application in the processing of audio data in workstations, for example, digital audio workstations (DAWs) where dereverberation is desirable. DAWs can comprise at least one processor and a computer readable storage medium. In one embodiment, the workstation can be a stand-alone device built specifically for handling audio production, mixing, and/or processing. For example, the workstation may have an integrated mixer, audio sequencer, and/or effects capabilities. In another embodiment, the workstation can comprise a personal computer with software being executed by a processor for the purpose of audio production, recording, mixing, and/or mastering.

In one aspect, the audio data can be stored when a computer records the audio file (e.g., in a recording environment). In another aspect, the computer may import and store a previously-recorded audio data. For example, at a mastering studio, a client may bring a CD containing an audio file, which is then accessed by computer. Alternatively, the client may provide a link for downloading the audio file onto computer, such as by sharing a cloud-computing folder containing audio data.

The audio file can include any file format that contains a representation of audio, such as (but not limited to) .WAV, .AIFF, .MP3, SDI1, AC3, DSD, or any number of audio file formats. For example, the audio file can be a .WAV file, which is compatible with the Windows™ operating system and typically contains non-compressed audio information. However, other file types are possible. For example, the digital audio file can include a video file type, such as .AVI, to the extent that the video file type includes an audio track or portion.

In another aspect, a processor can route the information to a digital processor module (e.g., plugin) that emulates analog hardware. This can allow for additional digital effects to be applied to the audio data in the digital domain in a way consistent with how effects are applied in real time in an analog domain.

In another aspect of the disclosure, the systems and methods described herein can find application in the processing of audio data in connection with Virtual Studio Technology (VST) where dereverberation is desirable. VST can refer to a software interface that integrates software audio synthesizer and effect plugins with audio editors and recording systems. VST and similar technologies can use digital signal processing to simulate traditional recording studio hardware in software.

In another aspect of the disclosure, the systems and methods described herein can find application in the processing of audio data in DAWs that can work with MIDI (Musical Instrument Digital Interface) files and audio files where dereverberation is desirable. MIDI can refer to an industry-standard protocol that enables electronic musical instruments, such as keyboard controllers, computers, and other electronic equipment, to communicate, control, and synchronize with each other. MIDI may not transmit an audio signal or media, but rather can transmit "event messages" such as the pitch and intensity of musical notes to play, control signals for parameters such as volume, vibrato and panning, cues, and clock signals to set the tempo.

Furthermore, using a MIDI controller coupled to a computer, a user can record MIDI data into a MIDI track. Using the DAW, the user can select a MIDI instrument that can be internal to a computer and/or an external MIDI instrument to generate sounds corresponding to the MIDI data of a MIDI track. The selected MIDI instrument can receive the MIDI data from the MIDI track and generate sounds corresponding to the MIDI data which can be produced by one or more monitors or speakers. For example, a user may select a piano software instrument on the computer to generate piano sounds and/or may select a tenor saxophone instrument on an external MIDI device to generate saxophone sounds corresponding to the MIDI data. The MIDI data and the resulting audio data generated can be processed by the methods and systems disclosed herein to, for example, remove reverberation.

Moreover, in another aspect of the disclosure, the systems and methods described herein can find application in the processing of audio data in connection with AM radio, particularly for talk radio and sports radio, and especially in moving vehicles or elsewhere when the received signal is of low or variable quality, and where dereverberation is desirable. The present invention can also be applied in connection with shortwave radio, broadcast analog television audio, cell phones, and headsets used in high-noise environments like tactical applications, aviation, fire and rescue, police and manufacturing.

In another aspect of the disclosure, the systems and methods described herein can find application in the processing of audio data used in voice command devices, for example, those used in mobile phones (i.e. Siri by Apple Inc., Cortana by Microsoft Corp., and the like), and computer/desktop environments using operating systems (e.g. Linux™, Microsoft Windows™ Apple OS X™, and the like) where dereverberation is desirable.

In another aspect of the disclosure, the systems and methods described herein can find application in connection with the processing of audio data used in in-car systems where dereverberation is desirable. This can include, for example, speech recognition systems used in cars. Simple voice commands may be used to initiate phone calls, select radio stations or play music from a compatible smartphone, MP3 player or music-loaded flash drive. The systems and methods can, for example, provide clearer audio for such voice commands.

While the methods and systems have been described in connection with preferred embodiments and specific examples, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following claims.

What is claimed is:

1. A method for the removal of reverberation from a signal, the method comprising:

receiving, by an audio processing system, a signal, wherein said audio processing system comprises at least a processor;

tracking, by the audio processing system, one or more overtones of the signal;

determining, by the audio processing system, cross-correlations between pairs of the overtones of the signal;

determining, by the audio processing system, an error associated with the cross-correlations between pairs of the overtones of the signal, wherein the error indicates a degree of deviation from perfect correlation among the overtone pairs; and creating an output signal of the audio processing system by removing, by the audio processing system, reverberation from the audio signal by filtering, using the audio processing system, the signal based on the determined error to maximize the cross correlations of the overtones, wherein said output signal is used in an audio system.

2. The method of claim 1, wherein removing reverberation from the signal by filtering the signal comprises using an adaptive filter for the removal of reverberation from the signal.

3. The method of claim 1, wherein the determining the error is performed from the cross-correlations among the overtone signal components with an adaptive filter tuning scheme.

4. The method of claim 1, wherein maximizing cross-correlations of the overtones based on the error is performed by adjusting one or more coefficients of the adaptive filter.

5. The method of claim 1, wherein tracking the overtones of the signal comprises determining an instantaneous frequency and amplitude of the overtones of the signal.

6. The method of claim 1, wherein tracking the overtones of the signal comprises tracking multiple overtones simultaneously using a Short Time Fourier Transform (STFT).

7. The method of claim 1, wherein tracking the overtones of the signal comprises isolating the overtones of the signal.

8. The method of claim 7, wherein the isolating the overtones of the signal is performed by a bank of filters or by a heterodyne detection method.

9. The method of claim 1, wherein determining the cross-correlation of the overtones of the signal comprises determining if the cross-correlation of the overtones of the signal is in an analog domain, a digital domain, or a partially analog, partially digital domain.

10. The method of claim 1, wherein removing reverberation from the signal by filtering the signal based on the determined error to maximize the cross correlations of the overtones comprises finding an inverse filter.

11. An audio processing system for the removal of reverberation from a signal, the system comprising:

memory containing computer-executable instructions;

a processor in communication with the memory, wherein the processor executes the computer-readable instructions, said instructions causing the processor to:

receive a signal;

track overtones of the signal;

determine cross-correlations between pairs of the overtones of the signal;

determine an error associated with the cross-correlations between pairs of the overtones of the signal, wherein the error indicates a degree of deviation from perfect correlation among the overtone pairs;

create an output signal of the audio processing system by removing reverberation from the signal by filtering the signal based on the determined error to maximize the cross correlations of the overtones; and provide the output signal to an output device.

12. The system of claim 11, wherein removing reverberation from the signal by filtering the signal comprises the processor executing computer-readable instructions to use an adaptive filter for the removal of reverberation from the signal.

13. The system of claim 11, wherein the processor executing computer-readable instructions to determine the error comprises the processor executing computer-readable instructions to determine the error from the cross-correlations among the overtone signal components with an adaptive filter tuning scheme.

14. The system of claim 11, wherein the processor executing computer-readable instructions to maximize cross-correlations of the overtones based on the error comprises the processor executing computer-readable instructions to adjust one or more coefficients of the adaptive filter.

15. The system of claim 11, the processor executing computer-readable instructions to track the overtones of the signal comprises the processor executing computer-readable instructions to track multiple overtones simultaneously using a Short Time Fourier Transform.

16. The system of claim 11, wherein the processor executing computer-readable instructions to track the overtones of the signal comprises the processor executing computer-readable instructions to isolate the overtones of the signal.

17. The system of claim 16, wherein the processor executing computer-readable instructions to isolate the overtones of the signal comprises the processor executing computer-readable instructions to isolate the overtones of the signal by a heterodyne detection method.

18. The system of claim 11, wherein the processor executing computer-readable instructions to determine if the cross-correlation of the overtones of the signal comprises the processor executing computer-readable instructions to determine if the cross-correlation of the overtones of the signal is in an analog domain, a digital domain, or a partially analog, partially digital domain.

19. The system of claim 11, wherein the processor executing computer-readable instructions to remove reverberation from the signal by filtering the signal based on the determined error to maximize the cross correlations of the overtones comprises the processor executing computer-readable instructions to find an inverse filter.

20. A non-transitory computer-readable medium having computer-executable instructions stored thereon, said computer-readable instructions for removal of reverberation from an audio signal by:

receiving a signal;

tracking overtones of the signal;

determining cross-correlations between pairs of the overtones of the signal;

determining an error associated with the cross-correlations between pairs of the overtones of the signal, wherein the error indicates a degree of deviation from perfect correlation among the overtone pairs; and creating an output signal by removing reverberation from the signal by filtering the signal based on the determined error to maximize the cross correlations of the overtones, wherein said output signal is used in an audio system.

* * * * *